US007627267B2

(12) United States Patent
Saiki

(10) Patent No.: US 7,627,267 B2
(45) Date of Patent: Dec. 1, 2009

(54) IMAGE FORMATION APPARATUS, IMAGE FORMATION UNIT, METHODS OF ASSEMBLING AND DISASSEMBLING IMAGE FORMATION APPARATUS, AND TEMPORARILY TACKING MEMBER USED FOR IMAGE FORMATION APPARATUS

(75) Inventor: Atsuna Saiki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 480 days.

(21) Appl. No.: 11/639,168

(22) Filed: Dec. 15, 2006

(65) Prior Publication Data

US 2007/0280732 A1 Dec. 6, 2007

(30) Foreign Application Priority Data

Jun. 1, 2006 (JP) ..... 2006-153474

(51) Int. Cl.
*G03G 21/18* (2006.01)

(52) U.S. Cl. ..... 399/113; 399/116; 399/117

(58) Field of Classification Search ..... 399/107, 399/109, 110, 111, 112, 113, 119, 117
See application file for complete search history.

(56) References Cited

U.S. PATENT DOCUMENTS

| | | | | |
|---|---|---|---|---|
| 6,301,458 | B1 * | 10/2001 | Mori et al. | 399/167 |
| 6,983,114 | B2 * | 1/2006 | Arimitsu | 399/114 |
| 7,272,342 | B2 * | 9/2007 | Nagashima et al. | 399/117 |
| 7,491,161 | B2 * | 2/2009 | Taguchi | 492/47 |
| 7,546,064 | B2 * | 6/2009 | Yoshino et al. | 399/117 |
| 7,561,826 | B2 * | 7/2009 | Takigawa | 399/111 |

FOREIGN PATENT DOCUMENTS

| | | |
|---|---|---|
| JP | A-08-054817 | 2/1996 |
| JP | A-11-119632 | 4/1999 |
| JP | A-2001-356549 | 12/2001 |
| JP | B-3389027 | 1/2003 |
| JP | A-2005-275266 | 10/2005 |

* cited by examiner

*Primary Examiner*—Hoan H Tran
(74) *Attorney, Agent, or Firm*—Morgan, Lewis & Bockius LLP

(57) ABSTRACT

An image formation apparatus includes; a drum; a first housing provided around the drum; a second housing provided around the first housing; a temporarily tacking section that temporarily tacks two members selected out of three members of the drum, the first housing and the second housing; and a supporting member that fixes each position of the drum, the first housing and the second housing.

16 Claims, 15 Drawing Sheets

IMAGE FORMATION APPARATUS, IMAGE FORMATION UNIT, METHODS OF ASSEMBLING AND DISASSEMBLING IMAGE FORMATION APPARATUS, AND TEMPORARILY TACKING MEMBER USED FOR IMAGE FORMATION APPARATUS

BACKGROUND

1. Technical Field

The present invention relates to an image formation apparatus such as a printer, a copying machine and a facsimile, an image formation unit, methods of assembling and disassembling the image formation apparatus and a temporarily tacking member used for the image formation apparatus.

2. Related Art

This type of image formation apparatus where an image carrier is uniformly charged by an charging member, a latent image is formed by an exposing device, the latent image is visualized with toner by a developing unit, a toner image is transferred on paper by a transfer unit and toner is fused on the paper by a fusing unit is well-known as xerography. Plural image carriers, plural exposing devices, plural developing units and plural transfer units are provided to a color image formation apparatus corresponding to the color of toner. Normally, an image formation apparatus is equipped with four types of color toner of cyan, magenta, yellow and black, and four sets of the above-mentioned units and devices are combined.

For such a color image formation apparatus, the one where an image carrier and others are united for one image carrier unit and further, these units are united for an image formation unit for tour colors is known.

However, in the related art, the image carrier and other components can be simply positioned because they are united for the image carrier unit, however, the image carrier and a housing of the image formation unit cannot be easily positioned because a housing the image carrier unit exists between them. For example, it is conceivable that a supporting shaft that supports the image carrier integrally supports three members of the image carrier, a housing of a photoconductor unit and the housing of the image formation unit and the three members are positioned, however, it is difficult in view of structure to position the three members at a time by the supporting shaft.

SUMMARY

According to an aspect of the invention, there is provided an image formation apparatus including a drum, a first housing provided around the drum, a second housing provided around the first housing, a temporarily tacking section that temporarily tacks two members selected out of three members of the drum, the first housing and the second housing and a supporting member that fixes each position of the drum, the first housing and the second housing.

BRIEF DESCRIPTION OF THE DRAWINGS

An exemplary embodiment of the present invention will be described in detail based on the following figures, wherein.

DETAILED DESCRIPTION

Figure 1:
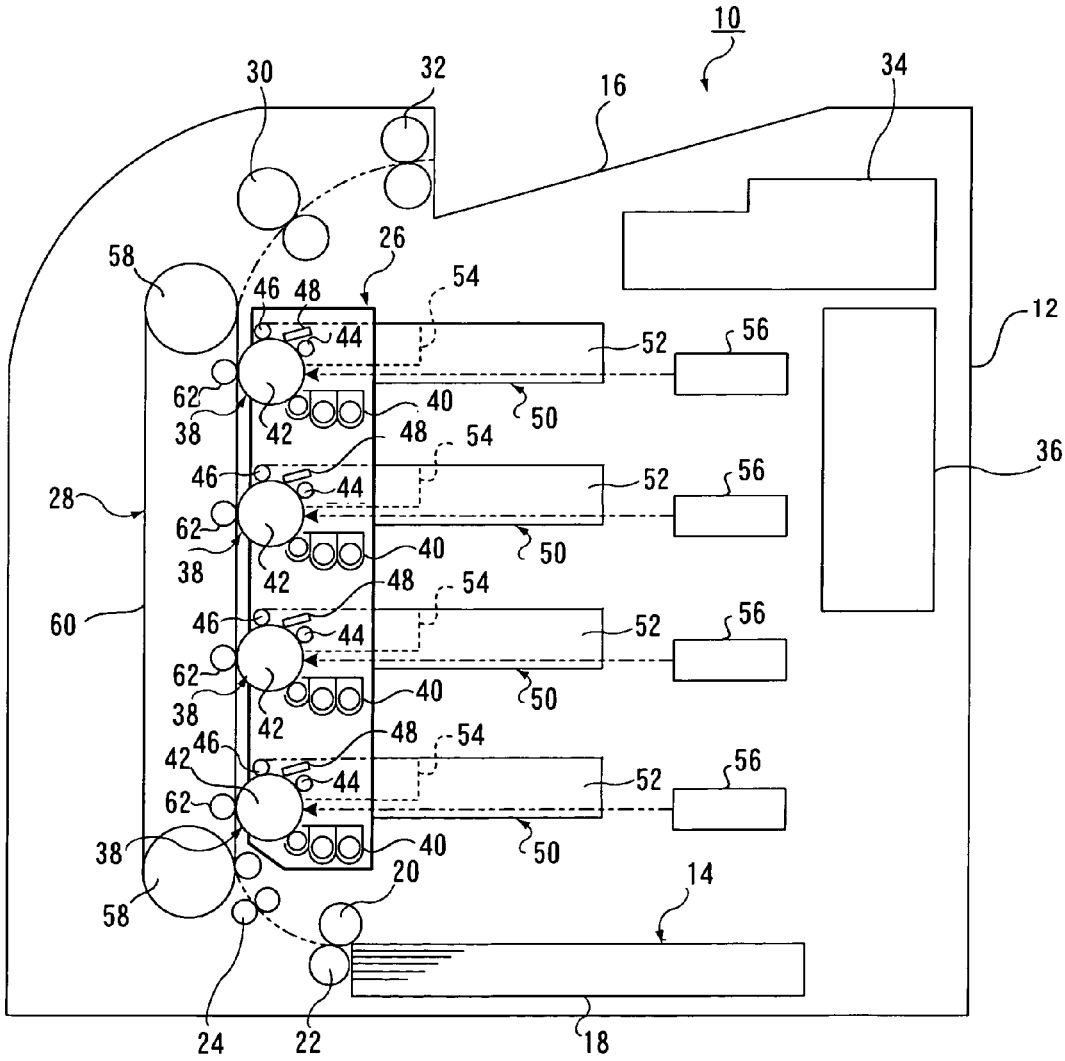
FIG. 1 is a side view showing an image formation apparatus equivalent to an exemplary embodiment of the invention.

Next, exemplary embodiments of the invention will be described referring to the drawings.

FIG. 1 shows an image formation apparatus 10 equivalent to the exemplary embodiment of the invention. The image formation apparatus 10 is provided with a body 12 of the image formation apparatus, a paper feeding device 14 is arranged on the downside of the body 12 of the image formation apparatus, and a paper ejecting device 16 is formed on the upside of the body 12 of the image formation apparatus.

The paper feeding device 14 is provided with a sheet tray 18 and multiple sheets (multiple sheets of paper) are piled on the sheet tray 18. A feed roller 20 is arranged on the upside of one end of the sheet tray 18 and a handling roller 22 is provided opposite to the feed roller 20. A topmost sheet of the multiple sheets on the sheet tray 18 is picked up by the feed roller 20, and the sheet is handled and carried by the collaboration of the feed roller 20 and the handling roller 22.

The sheet carried from the sheet tray 18 is temporarily stopped by registration rollers 24, passes between an image formation unit 26 and a transfer unit 28 and in a fusing unit 30 at predetermined timing, and is ejected to the paper ejecting device 16 by paper ejecting rollers 32.

The image formation unit 26, the transfer unit 28, a power supply unit 34 and a controller 36 are arranged in the body 12 of the image formation apparatus. The image formation unit 26 is provided with four image carrier units 38 and four developing units 40 for example corresponding to each color as described later. The image carrier unit 38 is supported so that an image carrier 42 can be rotated. Each image carrier 42 is provided with an charging member 44 as an charging section having an charging roller for uniformly charging each image carrier 42, an electrification removing member 46 as a removing section for removing electrification on each image carrier 42 after transfer and a cleaning blade 48 as a developer removing section for removing developer left on each of the image carriers 42 after the transfer around each image carrier 42.

Four toner boxes 50 are connected to the side on the back side of each image formation unit 26. Each of the toner boxes 50 is for magenta, yellow, cyan and black, and a toner supplying part 52 and a toner withdrawing part 54 are integrated. Each toner supplying part 52 is connected to each developing unit 40 to supply toner of each color to each developing unit 40, and each toner withdrawing part 54 withdraws the toner of each color removed by the cleaning blade 48.

Each optical writing unit 56 is formed by a laser beam exposing device, is arranged in a position corresponding to each image carrier 42 on the back side of the image formation unit 26, and forms a latent image by irradiating each uniformly charged image carrier 42 with a laser beam.

The transfer unit 28 is arranged lengthwise opposite to the image formation unit 26 on the front side of the image formation unit 26. As for the transfer unit 28, a conveyor belt 60 is wound on two supporting rollers 58 lengthwise provided. Each transfer member 62 is provided opposite to each image carrier 42 with the conveyor belt 60 between each transfer member and each image carrier. The image formation unit 26 can be detached from the body 12 of the image formation apparatus by pushing down the transfer unit 28.

Therefore, each image carrier 42 is uniformly charged by each charging member 44, a latent image is formed by each optical writing unit 56, and the latent image is visualized with toner by each developing unit 40. The toner image formed on each of the image carriers 42 is transferred on a conveyed sheet by each transfer member 62 of the transfer unit 28 in order from the downside and is fused on the sheet by the fusing unit 30.

Figure 2:
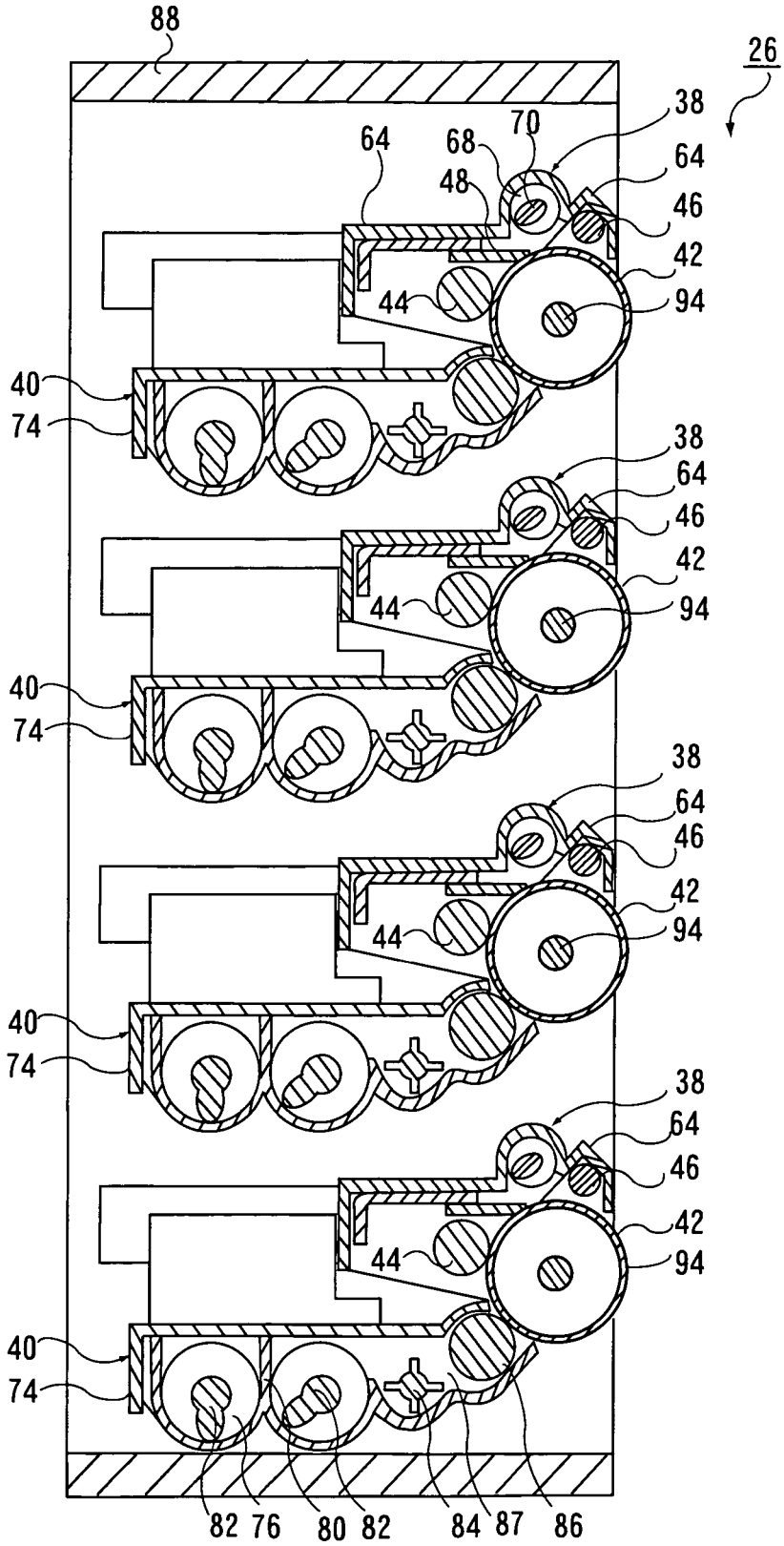
FIG. 2 is a sectional view showing an image formation unit used in the image formation apparatus equivalent to the exemplary embodiment of the invention.
Figure 3:
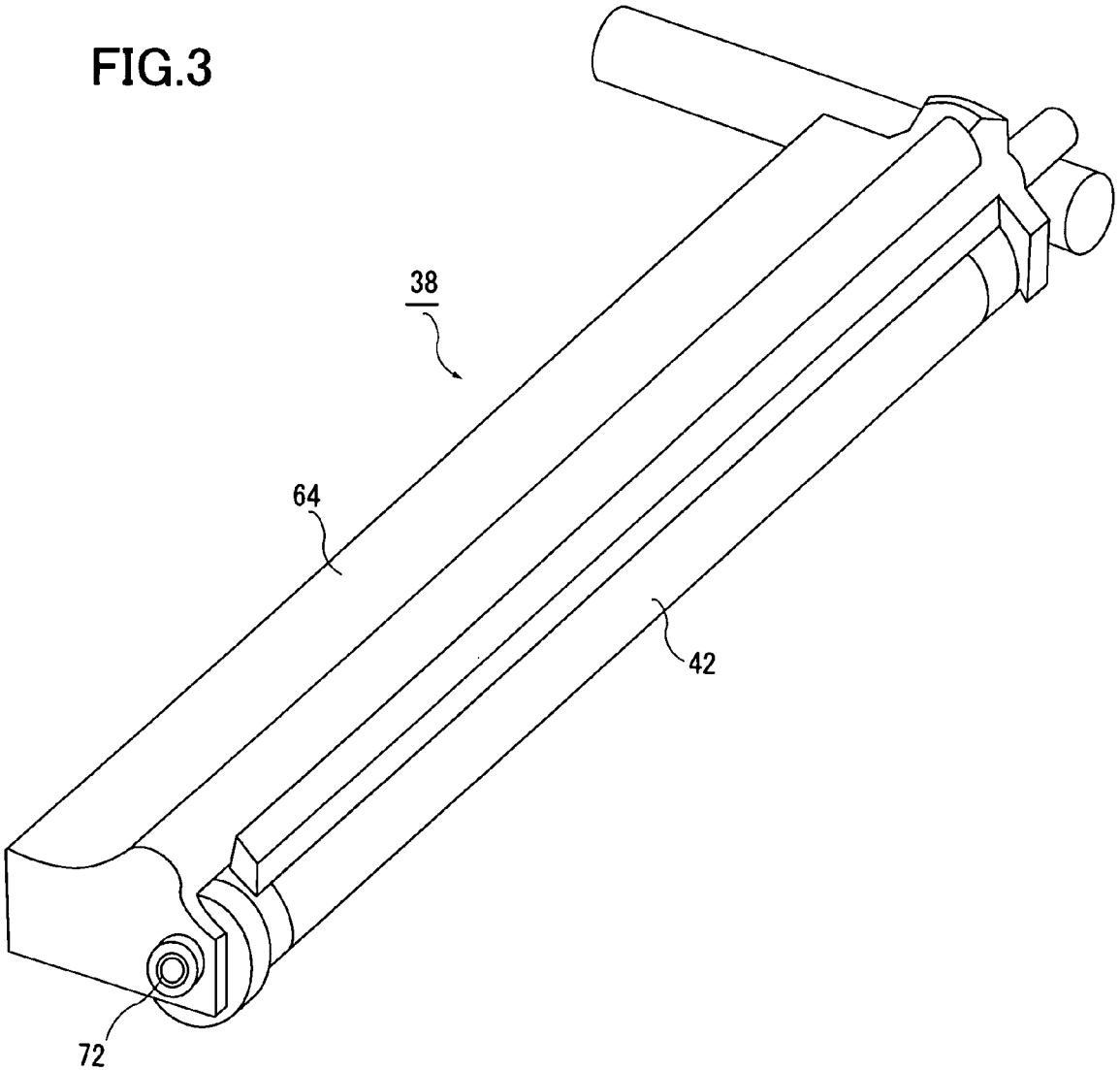
FIG. 3 is a perspective view showing an image carrier unit used in the image formation apparatus equivalent to the exemplary embodiment of the invention and viewed from the front side.
Figure 4:
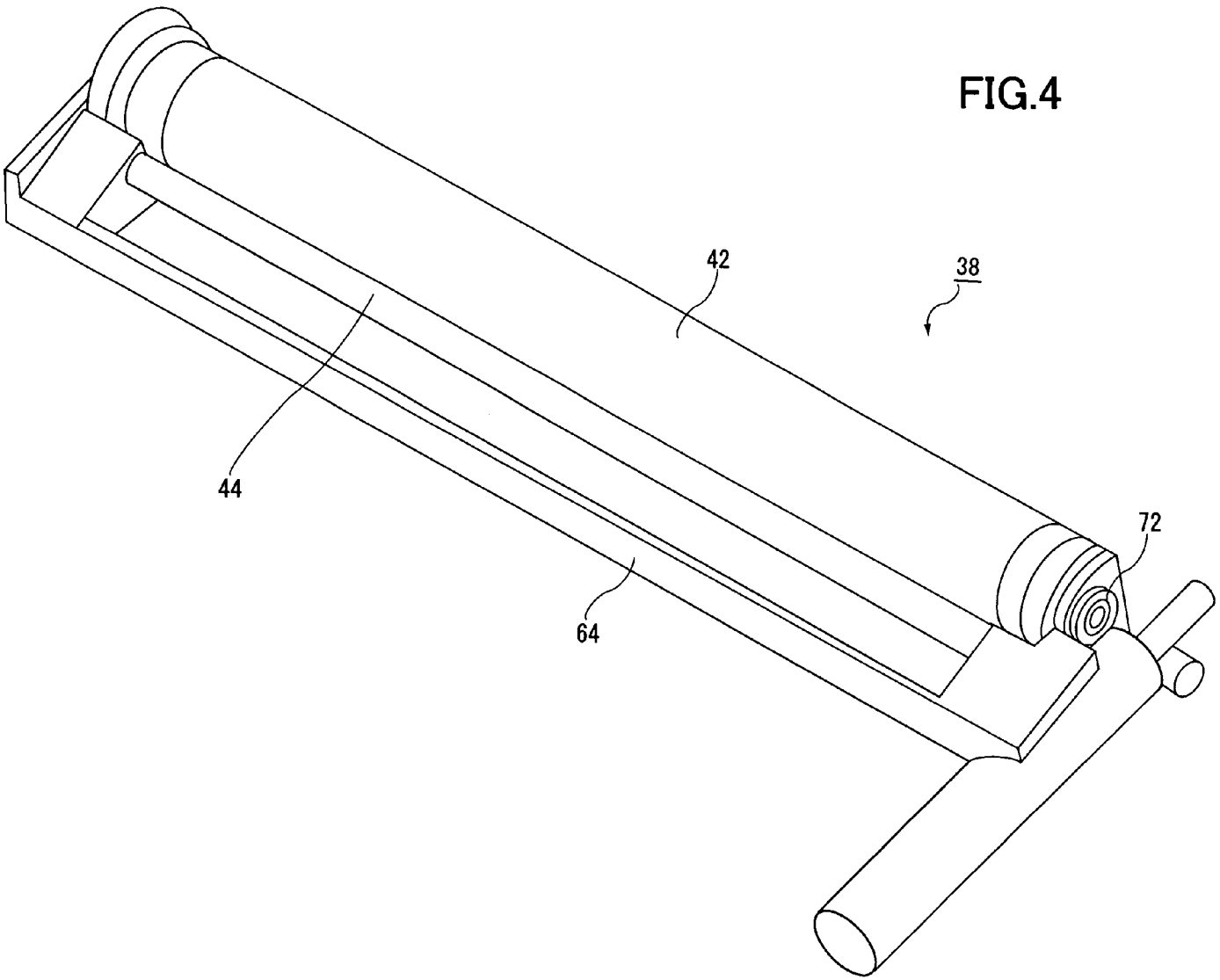
FIG. 4 is a perspective view showing the image carrier unit used in the image formation apparatus equivalent to the exemplary embodiment of the invention and viewed from the back side.

FIG. 2 shows the details of the image formation unit 26. FIGS. 3 and 4 show the image carrier unit 38 installed in the image formation unit 26. The image carrier unit 38 is provided with a first housing 64. The first housing 64 supports the image carrier 42 and the charging member 44 so that they can be rotated and supports the electrification removing member 46 and the cleaning blade 48. Both right and left sides and a top face of the first housing 64 are closed, the back is open to receive a modulated laser scanning beam from the optical writing unit 56, the front is open to confront the image carrier 42 with the transfer unit 28, and the bottom is open to confront a developing roller 86 described later of the developing unit 40 with the image carrier 42. Further, a toner withdrawing passage 68 is formed between the first housing 64 and the cleaning blade 48. An auger for withdrawing toner 70 is arranged in the toner withdrawing passage 68 so that the auger can be turned. The cleaning blade 48 is elastic and is in contact with the image carrier 42 so that the cleaning blade presses the image carrier downward for example. Therefore, toner left on the image carrier 42 is removed from the image carrier 42 by the cleaning blade 48, the removed toner is carried to one end by the auger for withdrawing toner 70 in the toner withdrawing passage 68, and is carried into the toner withdrawing part 54 of the toner box 50 connected to the toner withdrawing passage 68.

The image carrier 42 which is a drum and the first housing 64 are temporarily tacked on both right and left sides by temporarily tacking members 72, 72 as shown in FIGS. 3 and 4. The above-mentioned temporary tacking means to support the members in a manufacturing process, but when a product is completed, lose the function for supporting the members.

The developing unit 40 is provided with a body 74 of the developing unit, and a developer carrying part 76 and a developing part 78 are formed in the body 74 of the developing unit. The developing unit 40 complies with a binary system, the developer carrying part 76 is partitioned into two passages by a partition wall 80, augers for agitation and carriage 82, 82 are arranged in the respective passages, and the two passages are connected at axial both ends. The developer carrying part 76 is connected to the toner supplying part 52 of the toner box 50 described above and toner is supplied from the toner supplying part 52. Carriers are housed in the developer carrying part 76 beforehand, toner and the carriers are agitated and carried in an axial direction of the augers for agitation and carriage 82, 82 by the augers 82, 82, and the toner is charged. A paddle 84 and the developing roller 86 are arranged in the developing part 78. Developer including the agitated toner and carriers is supplied to the developing roller 86 via the paddle 84. The developing roller 86 is made of a well-known magnet roller, a magnetic brush is formed by the developer supplied onto the surface of the roller, and the toner is supplied to the image carrier 42 by the magnetic brush.

Figure 10:
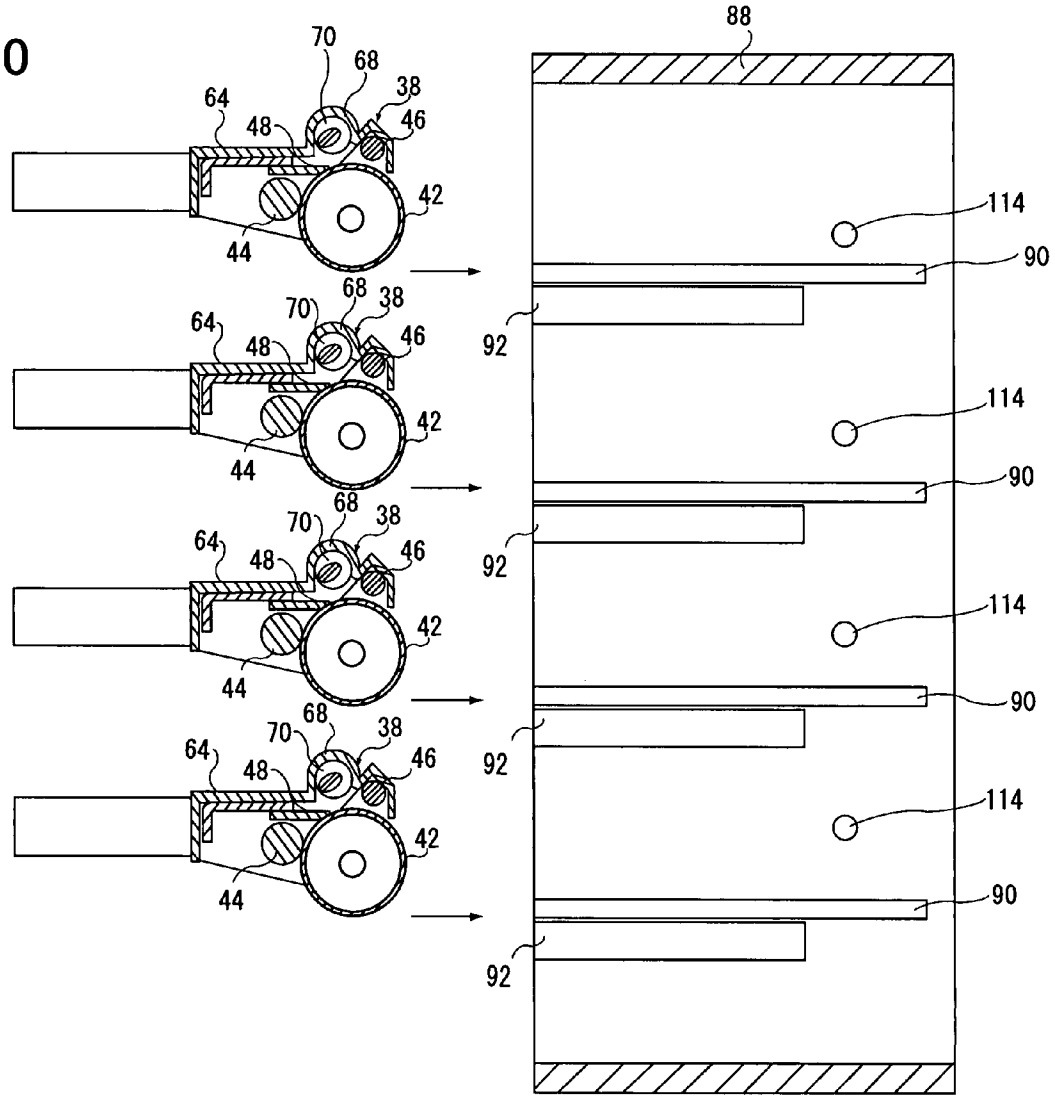
FIG. 10 is a sectional view showing a method of assembling the image formation unit used in the image formation apparatus equivalent to the exemplary embodiment of the invention and showing a state before the image carrier unit is installed in a second housing.

The image formation unit 26 is provided with a second housing 88. Both right and left sides, a top face and a bottom of the second housing 88 are closed, and four first grooves 90 extended before and behind and four second grooves 92 similarly extended before and behind are formed inside both right and left sides as shown in FIG. 10 for example. A rail not shown is provided to each image carrier unit 38 and each developing unit 40, the rail of each image carrier unit 38 is fitted into each first groove 90, the rail of each of the developing units 40 is fitted into each second groove 92, and the four image carrier units 38 and the four developing units 40 are supported by the second housing 88.

The image carrier 42, the first housing 64 and the second housing 88 respectively described above are supported and fixed by a supporting shaft 94 which is a supporting member. Support structure by the supporting shaft 94 will be described in detail using FIGS. 5 to 7 below.

Figure 5:
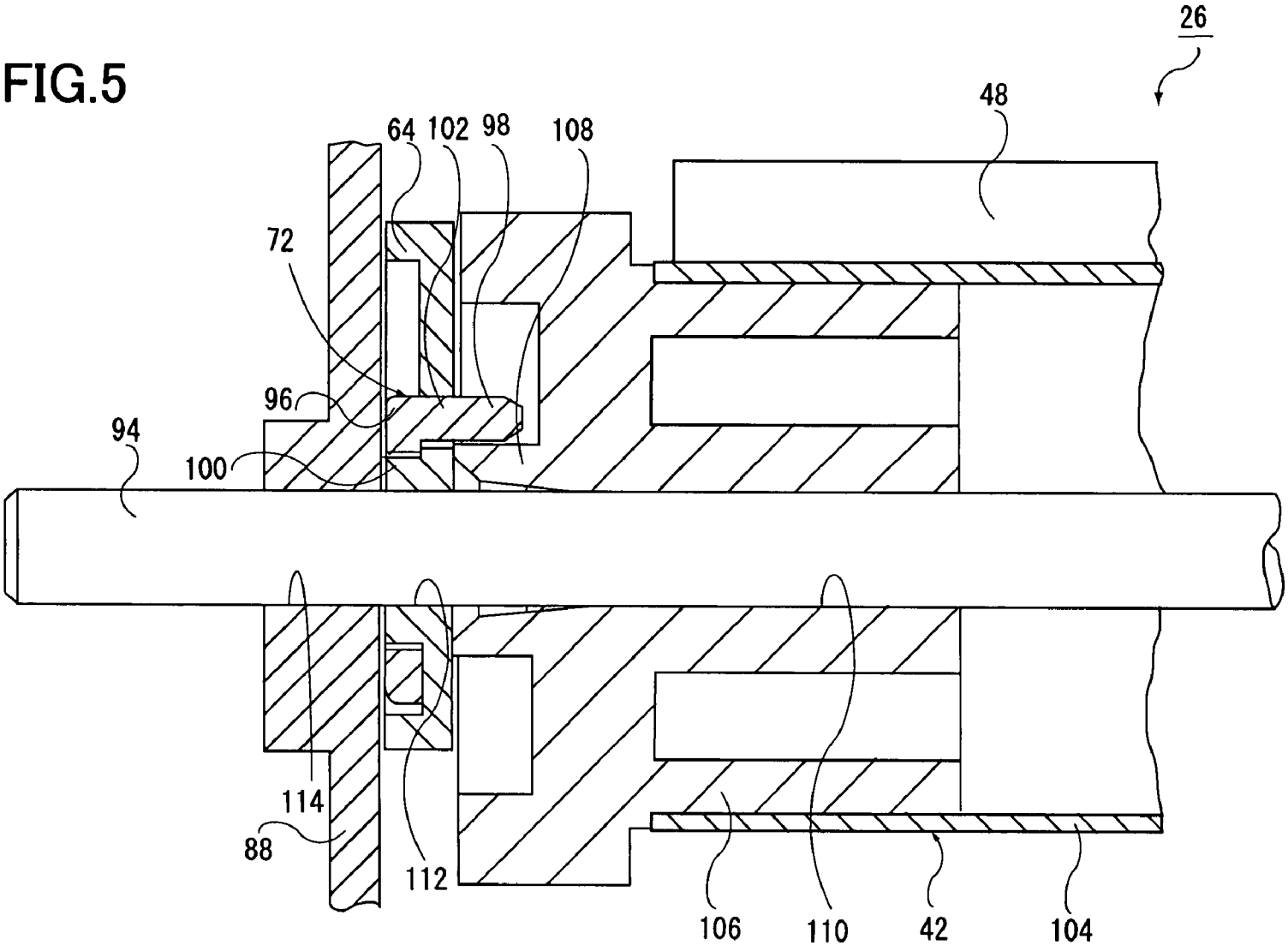
FIG. 5 is a sectional view showing a supported part after a supporting shaft is inserted in the image formation apparatus equivalent to the exemplary embodiment of the invention.
Figure 6:
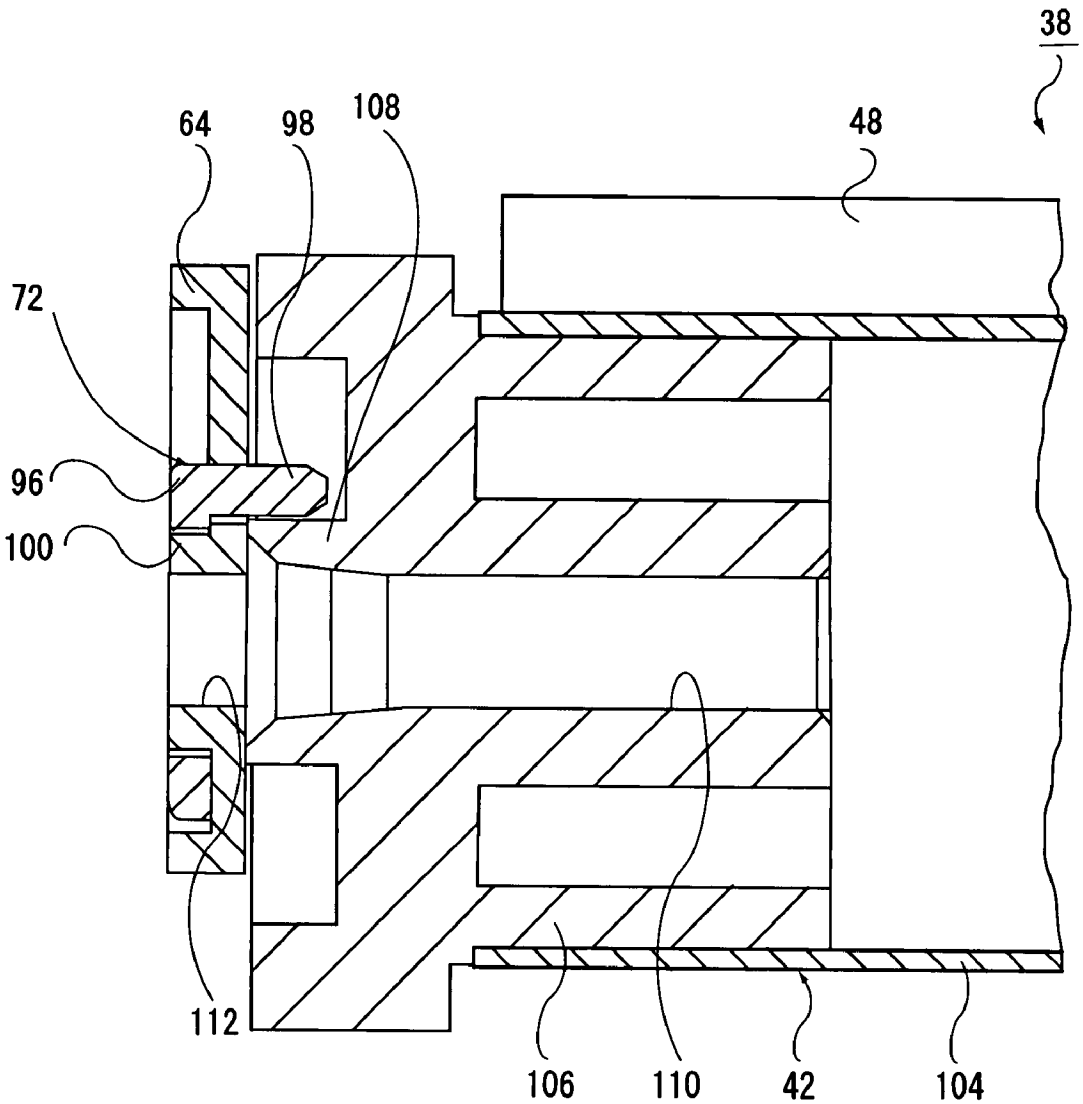
FIG. 6 is a sectional view showing the supported part before the supporting shaft is inserted in the image formation apparatus equivalent to the exemplary embodiment of the invention.
Figure 7:
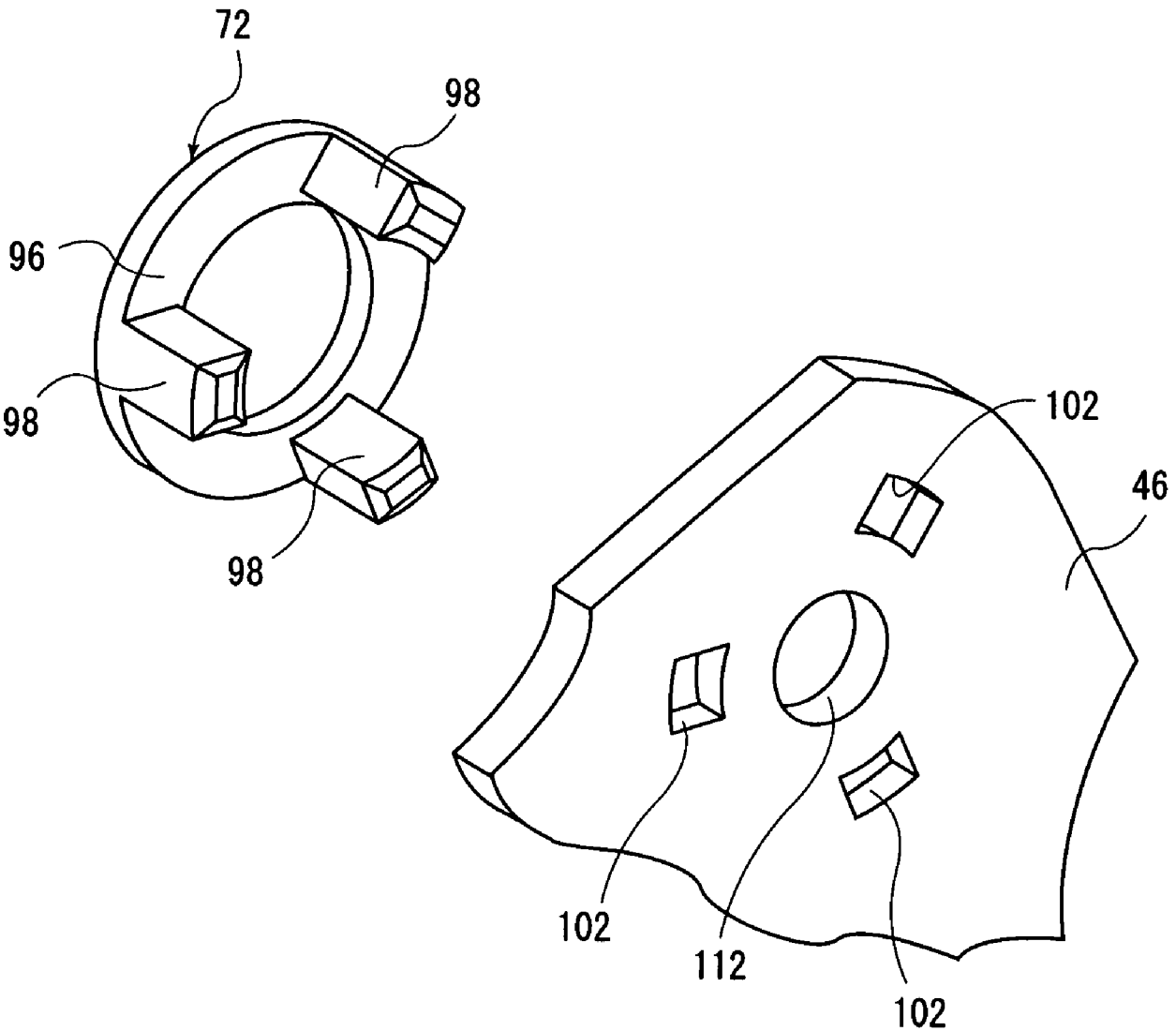
FIG. 7 is a perspective view showing a first housing and a temporarily tacking member respectively used in the image formation apparatus equivalent to the exemplary embodiment of the invention.

FIG. 5 is a sectional view showing a supported part after the supporting shaft 94 is inserted, FIG. 6 is a sectional view showing the supported part before the supporting shaft 94 is inserted, and FIG. 7 is a perspective view showing the first housing 64 and the temporarily tacking member 72.

The temporarily tacking member 72 is provided with a ringed first fitting part 96 for example and three second fitting parts 98 for example protruded from the first fitting part 96. In the meantime, a first fitted part 100 to which an inner face of the first fitting part 96 is fitted is formed on the side of the first housing 64 and three temporarily tacking member insertion openings 102 for example are formed around the first fitted part 100. The second fitting part 98 of the temporarily tacking member 72 is inserted into the temporarily tacking member insertion opening 102 and is protruded on the side of the image carrier 42.

The image carrier 42 is provided with a drum body 104 and a flange 106 provided on both sides of the drum body 104. A photosensitive layer is provided to the drum body 104 and a latent image is formed by a laser beam from the optical writing unit described above. The cleaning blade 48 is brought into contact with the drum body 104 of the image carrier 42 so that the cleaning blade presses the drum body 104. A second fitted part 108 is formed at one end of the flange 106 and an inner face of the second fitting part 98 of the temporarily tacking member 72 is fitted to the periphery of the second fitted part 108.

A first supporting shaft insertion opening 110, a second supporting shaft insertion opening 112 and a third supporting shaft insertion opening 114 are formed in the flange 106 of the image carrier 42, the first housing 64 and the second housing 88. The supporting shaft 94 is inserted into the first supporting shaft insertion opening 110, the second supporting shaft insertion opening 112 and the third supporting shaft insertion opening 114. The diameter of the supporting shaft 94 and each inside diameter of the first supporting shaft insertion opening 110, the second supporting shaft insertion opening 112 and the third supporting shaft insertion opening 114 are substantially equal, and therefore, the image carrier 42, the first housing 64 and the second housing 88 are fixed by the supporting shaft 94.

A predetermined gap is provided between the inside diameter of the second fitting part 98 of the above-mentioned temporarily tacking member 72 and the second fitted part 108 of the flange 106. Therefore, as shown in FIG. 6, before the supporting shaft 94 is inserted, there is a clearance between the second fitting part 98 of the temporarily tacking member 72 and the second fitted part 108 of the flange 106 so that they are roughly fixed. The clearance is provided close to the cleaning blade 48, and the second fitting part 98 and the second fitted part 108 respectively apart from the cleaning blade 48 are in contact because the image carrier 42 is pressed by the cleaning blade 48, and as the image carrier unit 38 itself, the image carrier 42 and the first housing 64 are temporarily tacked via the temporarily tacking member 72 in such a state.

However, as shown in FIG. 5, as the image carrier 42, the first housing 64 and the second housing 88 follow the supporting shaft 94 when the supporting shaft 94 is inserted, all the second fitting parts 98 of the temporarily tacking member 72 and the second fitted part 108 of the flange 106 are completely separated, and the temporarily tacking member 72 loses a function for fixing a position. Therefore, as the image carrier 42, the first housing 64 and the second housing 88 are fixed via the supporting shaft 94, positional relation between the image carrier 42 and the cleaning blade 48 or positional relation between the image carrier 42 and the developing unit 40 for example can be kept suitable.

Next, a method of assembling the image formation apparatus, particularly the image formation unit 26 will be described.

First, a method of assembling the image carrier unit 38 will be described.

Figure 8:
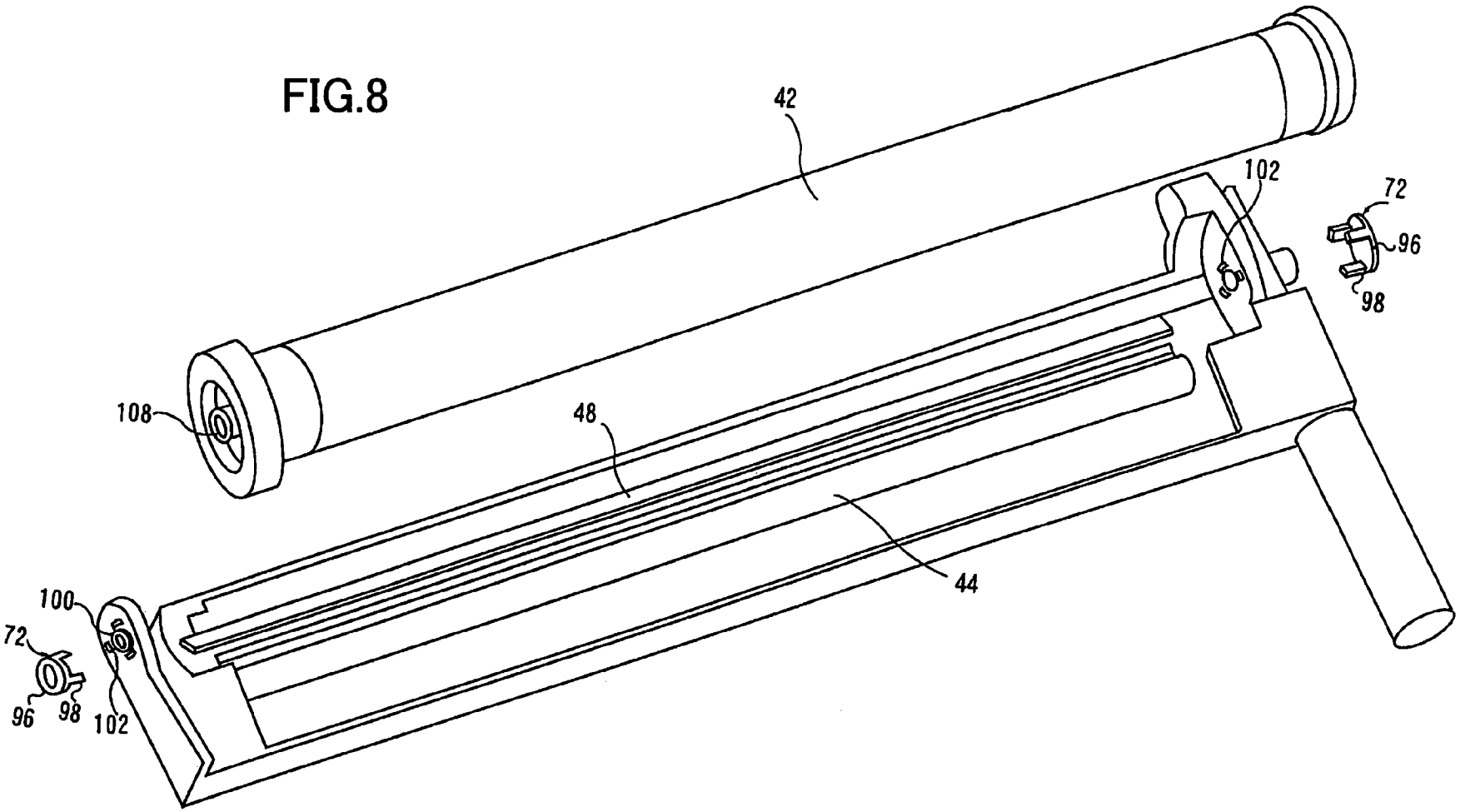
FIG. 8 is an exploded perspective view showing the image carrier unit used in the image formation apparatus equivalent to the exemplary embodiment of the invention.
Figure 9:
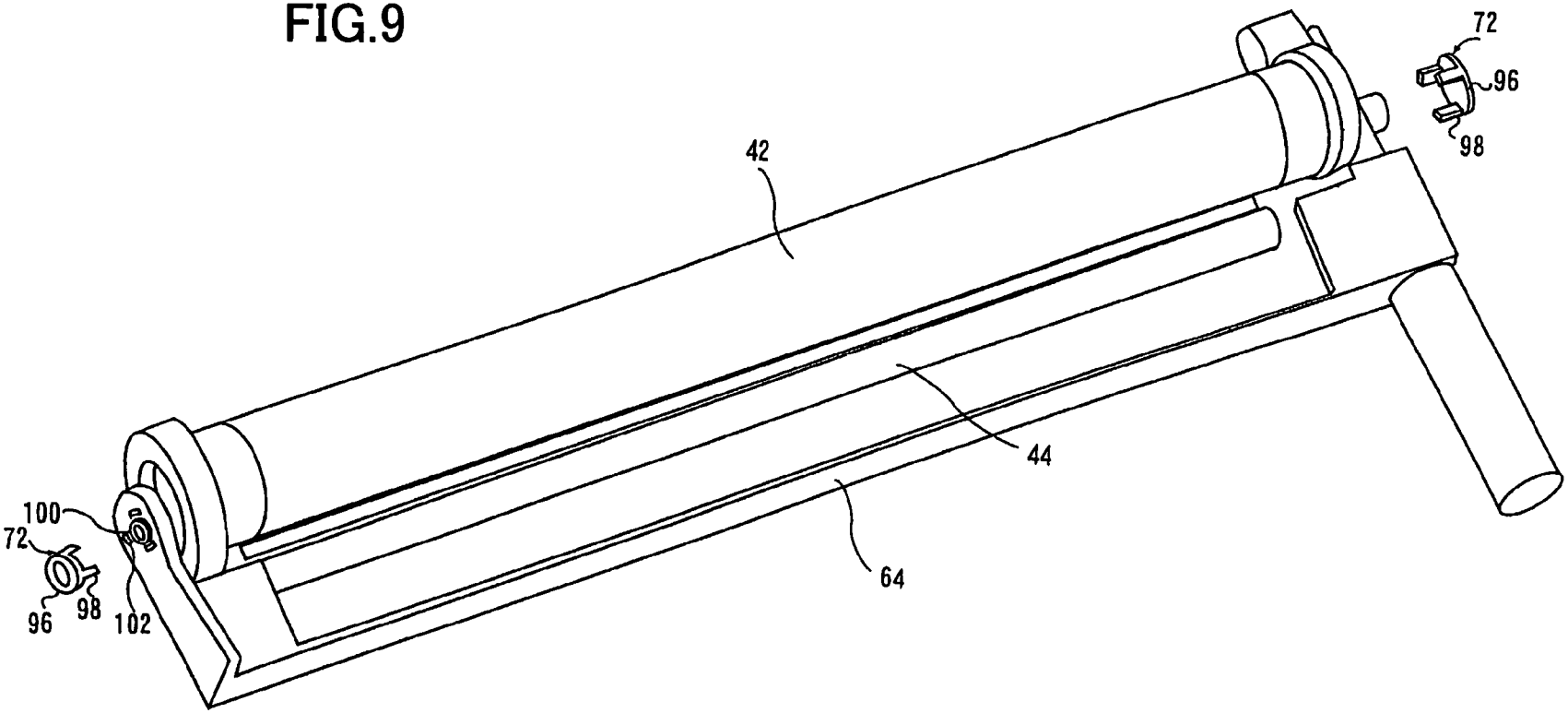
FIG. 9 is a perspective view showing a state in which an image carrier is installed before the image carrier unit used in the image formation apparatus equivalent to the exemplary embodiment of the invention is temporarily tacked.

As shown in FIG. 8, the charging member 44 and the cleaning blade 48 are built in the first housing 64 beforehand. Next, as shown in FIG. 9, the image carrier 42 is inserted into the first housing 64. The temporarily tacking members 72, 72 are fitted to the right and left sides of the first housing 64 and the assembly is completed. That is, the second fitting part 98 of the temporarily tacking member 72 is inserted into the temporarily tacking member insertion opening 102 of the first housing 64, the first fitting part 96 of the temporarily tacking member 72 is fitted to the first fitted part 100 of the first housing 64, and the second fitting part 98 of the temporarily tacking member 72 is fitted to the second fitted part 108 of the image carrier 42. Hereby, the image carrier 42 and the first housing 64 are temporarily tacked via the temporarily tacking member 72 and the image carrier unit 38 is completed. The image carrier 42 is pressed by the cleaning blade 48, and the second fitting part 98 of the temporarily tacking member 72 and the second fitted part 108 of the image carrier 42 are roughly fixed. However, the position of the first supporting shaft insertion opening 110 of the image carrier 42 and the position of the second supporting shaft insertion opening 112 of the first housing 64 are substantially matched (see FIG. 6).

Next, as shown in FIG. 10, the image carrier unit 38 assembled as described above is inserted into the second housing 88. The position of the first supporting shaft insertion opening 110 of the image carrier 42, the position of the second supporting shaft insertion opening 112 of the first housing 64 and the position of the third supporting shaft insertion opening 114 of the second housing 88 are substantially matched.

Figure 11:
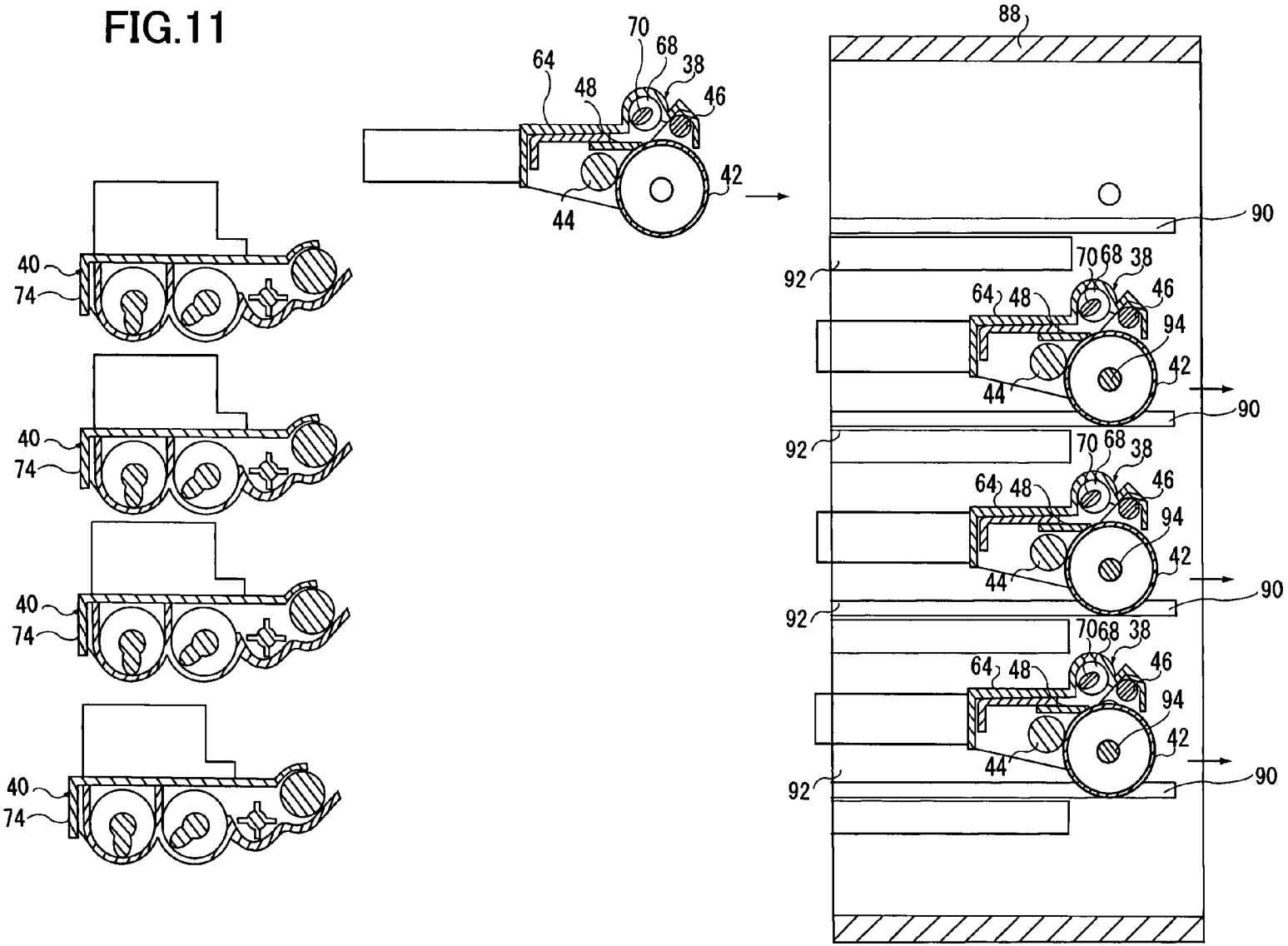
FIG. 11 is a sectional view showing the method of assembling the image formation unit used in the image formation apparatus equivalent to the exemplary embodiment of the invention and showing a state in which three image carrier units are installed in the second housing.
Figure 12:
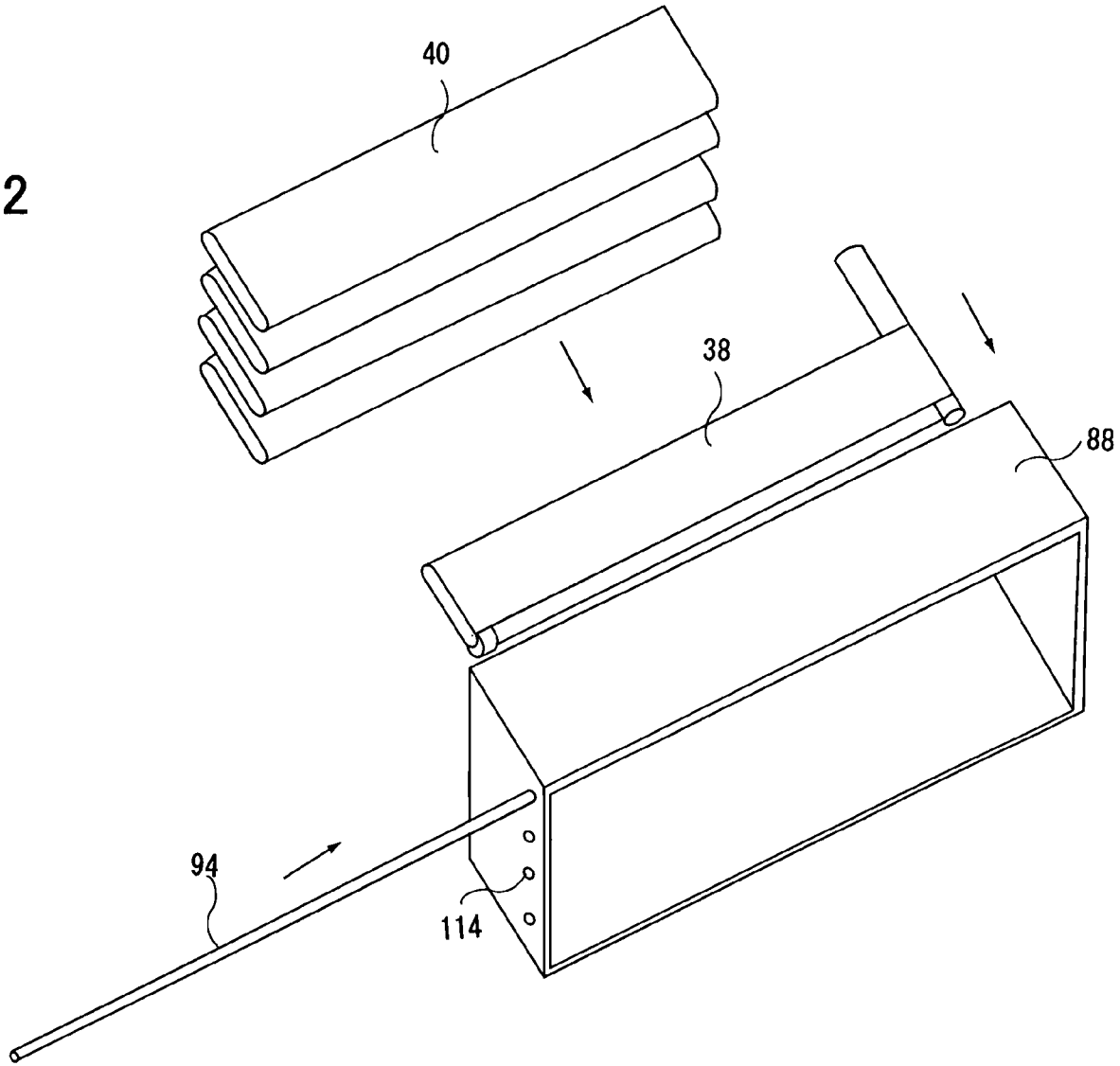
FIG. 12 is a perspective view showing the method of assembling the image formation unit used in the image formation apparatus equivalent to the exemplary embodiment of the invention.

Next, as shown in FIGS. 11 and 12, after the image carrier unit 38 is installed in the second housing 88, the supporting shaft 94 is inserted via the third supporting shaft insertion opening 114 of the second housing 88. When the supporting shaft 94 is inserted via the third supporting shaft insertion opening 114, the supporting shaft is automatically inserted into the second supporting shaft insertion opening 112 of the first housing 64 and the first supporting shaft insertion opening 110 of the image carrier 42, is further automatically inserted into the first supporting shaft insertion opening 110, the second supporting shaft insertion opening 112 and the third supporting shaft insertion opening 114 respectively on the reverse side, and pierces the second housing 88. When the piercing of the second housing by the supporting shaft 94 is finished, the supporting shaft 94 is fixed to the second housing 88 by a pin and others.

Figure 13:
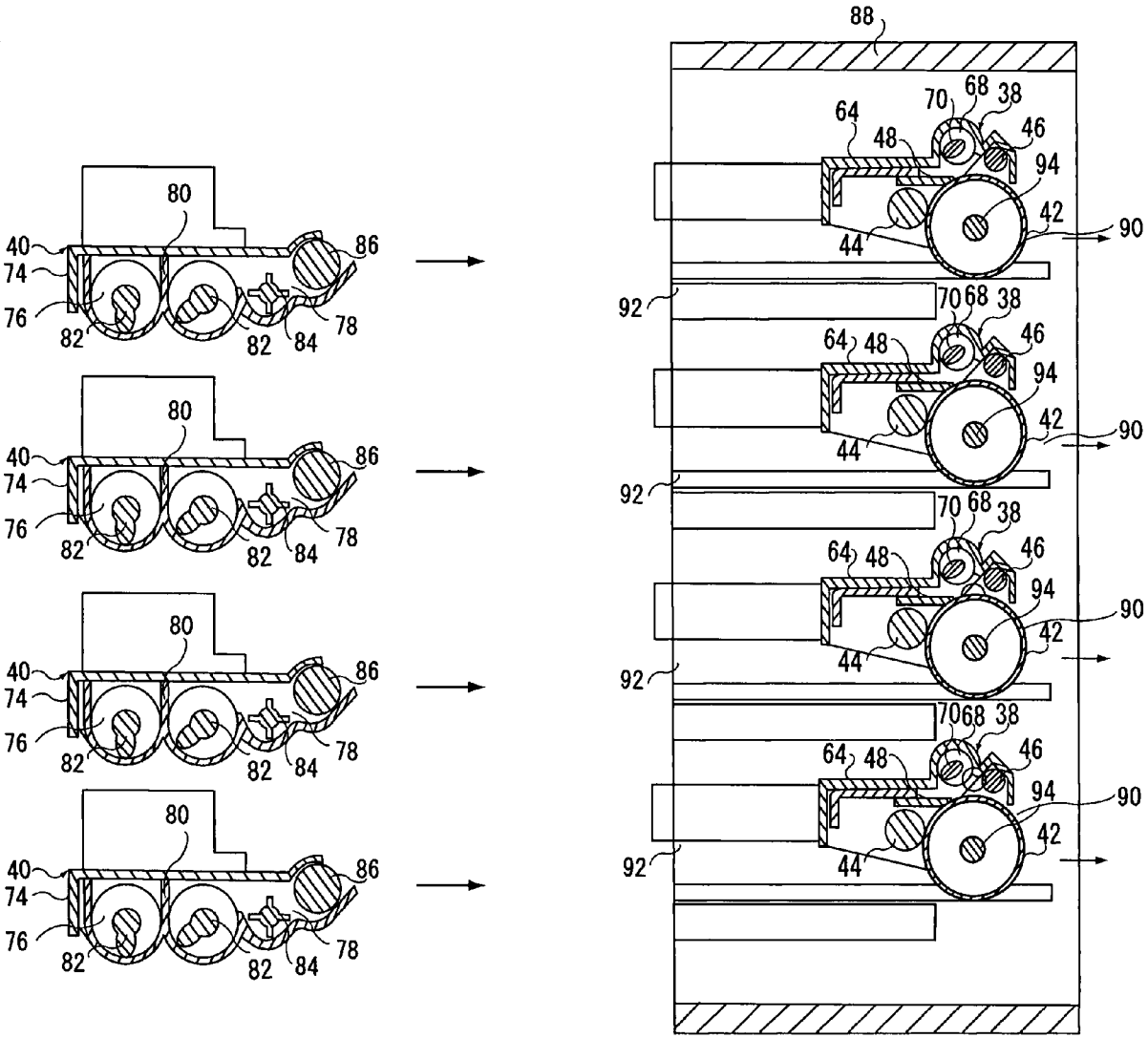
FIG. 13 is a sectional view showing the method of assembling the image formation unit used in the image formation apparatus equivalent to the exemplary embodiment of the invention and showing a state after the image carrier unit is installed in the second housing and before a developing unit is installed.

Finally, as shown in FIG. 13, the assembly of the image formation unit 26 can be completed by installing the developing unit 40 in the second housing 88.

If the image carrier 42 and the first housing 64 are assembled without temporarily tacking, the supporting shaft 94 is required to be pierced, supporting so that the supporting shaft 94 pierces three parts of the image carrier 42, the first housing 64 and the second housing 88 and in addition, in a state in which the image carrier 42 is pressed by the cleaning blade 48, and the work is difficult. However, as in this exemplary embodiment, as the image carrier 42 and the first housing 64 are temporarily tacked by the temporarily tacking member 72, the supporting shaft 94 can be simply pierced by fitting the temporarily tacked image carrier unit 38 into the second housing 88 and in addition, the work can be performed without being influenced by pressure on the image carrier 42 by the cleaning blade 48.

When the image formation apparatus assembled as described above is disassembled, reverse work to the above-mentioned work has only to be performed. That is, the image carrier unit 38 temporarily tacked to the second housing 88 can be detached from the second housing by pulling out the supporting shaft 94.

Figure 14:
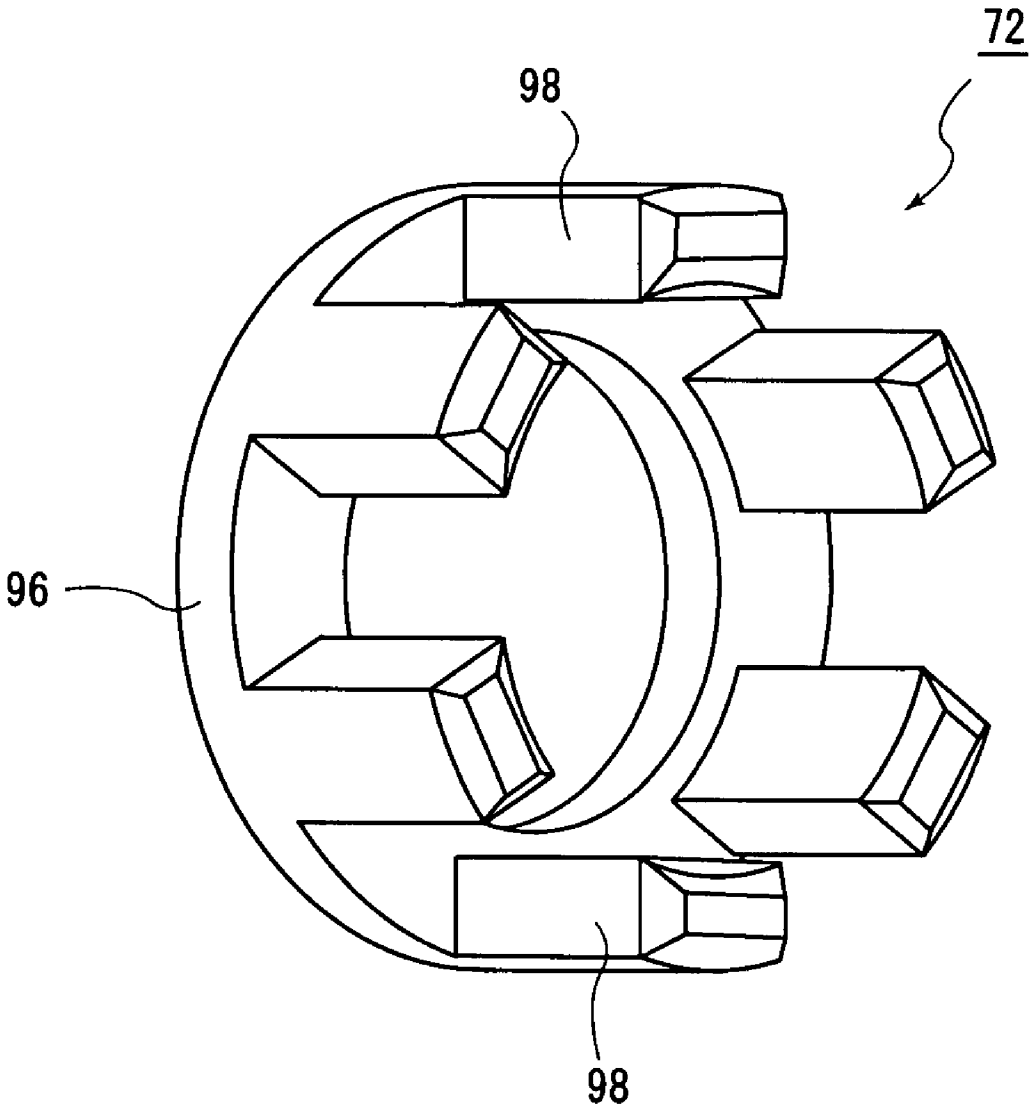
FIG. 14 is a perspective view showing a first modified example of the image formation apparatus equivalent to the exemplary embodiment of the invention.

FIG. 14 shows a first modified example. The temporarily tacking member 72 in the above-mentioned exemplary embodiment is provided with the three second fitting parts 98. However, plural second fitting parts 98 have only to be provided and for example, as shown in FIG. 14, six second fitting parts 98 may also be provided.

Figure 15:
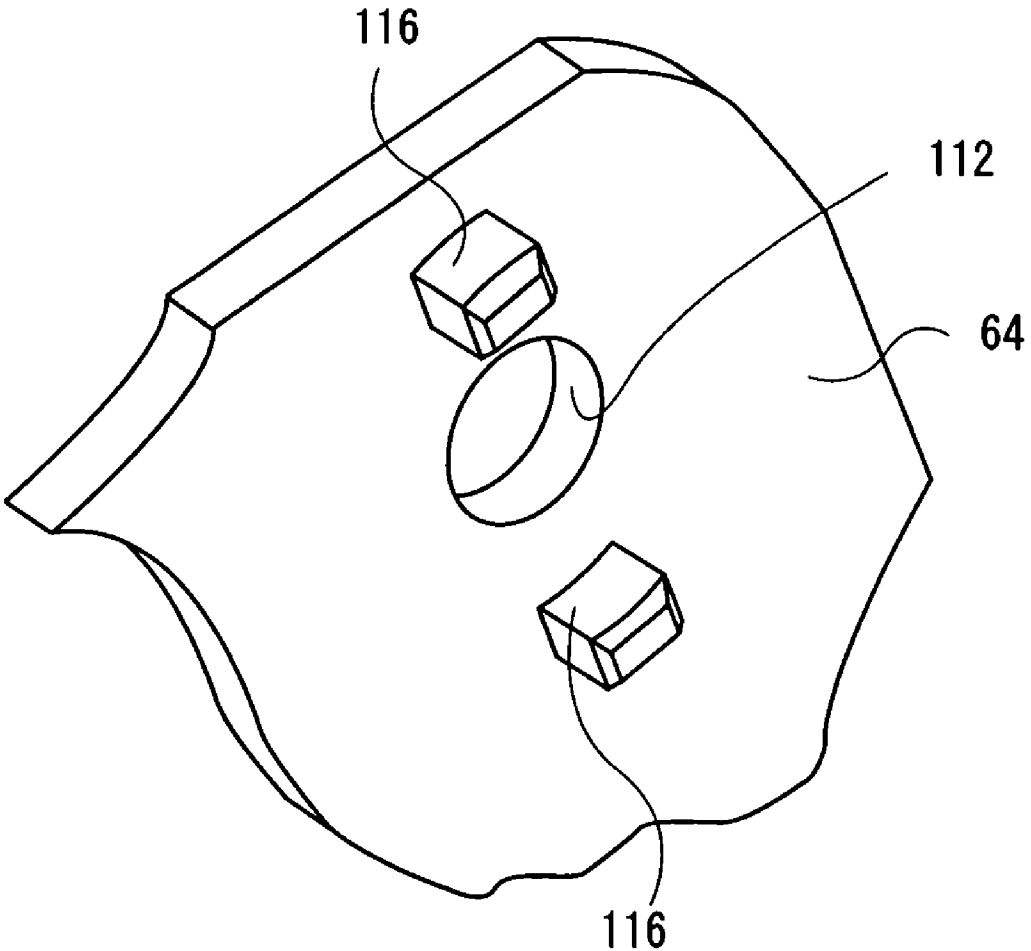
FIG. 15 is a perspective view showing a second modified example of the image formation apparatus equivalent to the exemplary embodiment of the invention.

FIG. 15 shows a second modified example. In the above-mentioned exemplary embodiment, the image carrier 42 and the first housing 64 are temporarily tacked by the temporarily tacking member 72. In the second modified example, however, temporarily tacking parts 116 integrally protruded from the first housing 64 are provided, and the image carrier 42 and the first housing 64 may also be temporarily tacked by the temporarily tacking parts 116. Further, the temporarily tacking part 116 may also be provided on the side of the image carrier 42 in place of the first housing 64.

As described above, as the part for temporarily tacking the image carrier 42 and the first housing 64 may also be provided separately or may also be integrated, a word of a temporarily tacking member is used in claims.

In the above-mentioned exemplary embodiment, the image carrier 42 and the first housing 64 are temporarily tacked. In another exemplary embodiment, however, an image carrier 42 and a second housing 88 or a first housing 64 and the second housing 88 may also be temporarily tacked and in short, in the exemplary embodiments of the invention, two members selected out of the three members of the image carrier 42, the first housing 64 and the second housing 88 have only to be temporarily tacked.

As described above, the invention can be applied to an image formation apparatus designed to enhance positioning precision and to facilitate the assembly and the disassembly.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image formation apparatus, comprising:

a drum;

a first housing provided around the drum;

a second housing provided around the first housing;

a temporarily tacking section that temporarily tacks two members selected out of three members of the drum, the first housing and the second housing; and a supporting member that fixes each position of the drum, the first housing and the second housing.

2. The image formation apparatus according to claim 1, wherein the supporting member is a supporting shaft inserted into the drum, the first housing and the second housing.

3. The image formation apparatus according to claim 1, wherein the drum is an image carrier.

4. The image formation apparatus according to claim 3, further comprising a cleaning blade brought into contact with the image carrier, wherein the cleaning blade, the first housing and the image carrier constitute an image carrier unit.

5. The image formation apparatus according to claim 3, wherein the temporarily tacking section temporarily tacks the image carrier and the first housing.

6. The image formation apparatus according to claim 5, wherein the temporarily tacking section is provided with a first fitting part fitted to the first housing and a second fitting part fitted to the image carrier.

7. The image formation apparatus according to claim 5, wherein the temporarily tacking section is integrated with the first housing.

8. The image formation apparatus according to claim 4, comprising a plurality of image carrier units, wherein the plurality of image carrier units are supported by the second housing.

9. An image formation apparatus, comprising:

an image carrier unit provided with an image carrier, a cleaning blade brought into contact with the image carrier, a first housing provided around the image carrier and a temporarily tacking section that temporarily tacks the first housing and the image carrier;

an image formation unit including a plurality of image carrier units and a second housing provided around the plurality of image carrier units; and a supporting member that fixes each position of the image carrier, the first housing and the second housing.

10. The image formation apparatus according to claim 9, wherein the image formation unit is further provided with a developing unit corresponding to the image carrier unit.

11. An image formation apparatus, comprising:

a drum;

a first housing provided around the drum;

a second housing provided around the first housing;

a temporarily tacking member provided with a first fitting part fitted to one member selected out of three members of the drum, the first housing and the second housing and a second fitting part fitted to another member selected out of the three members; and a supporting member that fixes each position of the drum, the first housing and the second housing.

12. An image formation unit, comprising:

a plurality of image carrier units each of which is provided with an image carrier, a cleaning blade brought into contact with the image carrier, a first housing provided around the image carrier and a temporarily tacking section that temporarily tacks the first housing and the image carrier;

a second housing provided around the plurality of image carrier units; and a supporting member that fixes each position of the image carrier, the first housing and the second housing.

13. A method of assembling an image formation apparatus, comprising:

temporarily tacking two members selected out of three members of a drum, a first housing provided around the drum and a second housing provided around the first housing; and inserting a supporting shaft into the drum, the first housing and the second housing and fixing each position of the drum, the first housing and the second housing.

14. A method of disassembling an image formation apparatus, comprising:

extracting a supporting shaft which is inserted into a drum, a first housing provided around the drum and a second housing provided around the first housing and fixes each position of the drum, the first housing and the second housing, two members selected out of the three members of the drum, the first housing and the second housing having been temporarily tacked.

15. A temporarily tacking member that temporarily tacks two members selected out of three members of a drum, a first housing provided around the drum and a second housing provided around the first housing, a supporting shaft being inserted into the drum, the first housing and the second housing, and each position of the drum, the first housing and the second housing being fixed after temporary tacking by the temporarily tacking member.

16. The temporarily tacking member according to claim 15, wherein the temporarily tacking member is provided a first fitting part and second fitting parts that are protruded from the first fitting part.

* * * * *